US006628911B2

(12) United States Patent
Konno

(10) Patent No.: US 6,628,911 B2
(45) Date of Patent: Sep. 30, 2003

(54) IMAGE FORMING APPARATUS

(75) Inventor: Shinichi Konno, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/067,298

(22) Filed: Feb. 7, 2002

(65) Prior Publication Data

US 2003/0147668 A1 Aug. 7, 2003

(51) Int. Cl.[7] ..... G03G 15/00; G03G 21/00
(52) U.S. Cl. ..... 399/124; 399/121; 399/317
(58) Field of Search ..... 399/124, 125, 399/121, 107, 317, 316, 322

(56) References Cited

U.S. PATENT DOCUMENTS 4,443,101 A * 4/1984 Sakurai et al. ..... 399/121 X
5,008,710 A * 4/1991 Kobayashi et al. ..... 399/317
5,134,443 A * 7/1992 Sumi et al. ..... 399/121
5,771,428 A * 6/1998 Marumoto et al. ..... 399/124
6,026,272 A 2/2000 Kusaka et al. ..... 399/327

FOREIGN PATENT DOCUMENTS

JP 04-156578 * 5/1992

* cited by examiner

*Primary Examiner*—Sophia S. Chen
(74) *Attorney, Agent, or Firm*—Fitzpatrick, Cella, Harper & Scinto

(57) ABSTRACT

An object of the present invention is to provide an image forming apparatus that has an image bearing member, first conveying device for conveying a sheet along a conveying path, transferring device, which is provided opposing the image bearing member across the conveying path, for transferring a toner image formed on the image bearing member to a sheet to be conveyed by the first conveying device, second conveying device, which is provided between the first conveying device and the transferring device, for conveying a recording material to be conveyed from the first conveying device to the transferring device, and holding device for holding the second conveying device and the transferring device, wherein the holding device is capable of opening the conveying path between the transferring device and the image bearing member.

10 Claims, 4 Drawing Sheets

IMAGE FORMING APPARATUS

BACKGROUND OF THE INVENTION

1. Field of the Invention

The present invention relates to an image forming apparatus such as a copying machine and a printer that is provided with a function of forming an image on a sheet.

2. Description of Related Art

Conventionally, as an image forming apparatus of this kind, there is known an image forming apparatus in which a roller pair that is usually called a registration roller pair is arranged on the upstream side of a photosensitive drum acting as image forming means, the registration roller pair being axially supported rotatably on front and behind side plates of an apparatus main body.

The role of the registration roller pair is to temporarily stop a sheet, which is forwarded from sheet supporting means for containing sheets such as a cassette, at a nip portion, correct tip skew of the sheet (skew feeding correction) and adjust timing such that the tip of the sheet fits on an image position of a rotating photosensitive drum to forward the sheet. A roller pressure (pressing force of the roller) of the registration roller pair is required to be set high (approximately 2 kg or more) for correcting skew feeding and, moreover, a clutch such as an electromagnetic clutch for turning on and off transmission of a driving force from a driving source is required to be provided coaxially with the registration roller pair in order to temporarily stop a sheet. Thus, it is a general practice to attach the registration roller pair to front and rear side plates having a large strength in order to bear a high roller pressure and support a heavy clutch.

However, in case of the conventional structure, if paper jamming occurs, when a sheet is in the state in which it is slightly bit by the registration roller pair, since the jammed sheet cannot be seen behind the front side plate even if a transferring portion is opened, jam processing is difficult. In addition, if the image forming apparatus is structured such that the transferring portion is opened together with the registration roller pair, since the clutch is located coaxially, a swinging gear or the like is used for a method of transmitting a driving force. Thus, it is likely that a structure of a driving force transmitting system becomes so complicated that efficiency of transmitting a driving force is reduced, whereby a sheet conveying property declines.

In addition, there is known a system for opening a roller on the driven side of the registration roller pair while holding a roller on the driving side on the main body side. However, since a roller pressure of the registration roller pair is high as described above, a high strength is required for a frame member for supporting a transferring portion and the registration roller pair. Thus, there are inconveniences in that a pressurizing force for lifting the frame increases and, furthermore, alignment of the registration roller pair tends to be collapsed because the registration roller pair is opened.

SUMMARY OF THE INVENTION

The present invention has been devised in order to solve the above-mentioned subjects of the prior art, and it is an object of the present invention to provide an image forming apparatus that improves a jam processing property in a transferring portion and is excellent in quality and reliability.

In order to achieve the above-mentioned object, according to the present invention, there is provided an image forming apparatus including: an image bearing member; first conveying means for conveying a sheet along a conveying path; transferring means, which is provided opposing the image bearing member across the conveying path, for transferring a toner image formed on the image bearing member to a sheet to be conveyed by the first conveying means; second conveying means, which is provided between the first conveying means and the transferring means, for conveying a recording material to be conveyed from the first conveying means to the transferring means; and holding means for holding the second conveying means and the transferring means, in which the holding means is capable of opening the conveying path between the transferring means and the image bearing member.

DETAILED DESCRIPTION OF THE PREFERRED EMBODIMENT

An embodiment of the present invention will be hereinafter described with reference to the accompanying drawings.

Figure 1:
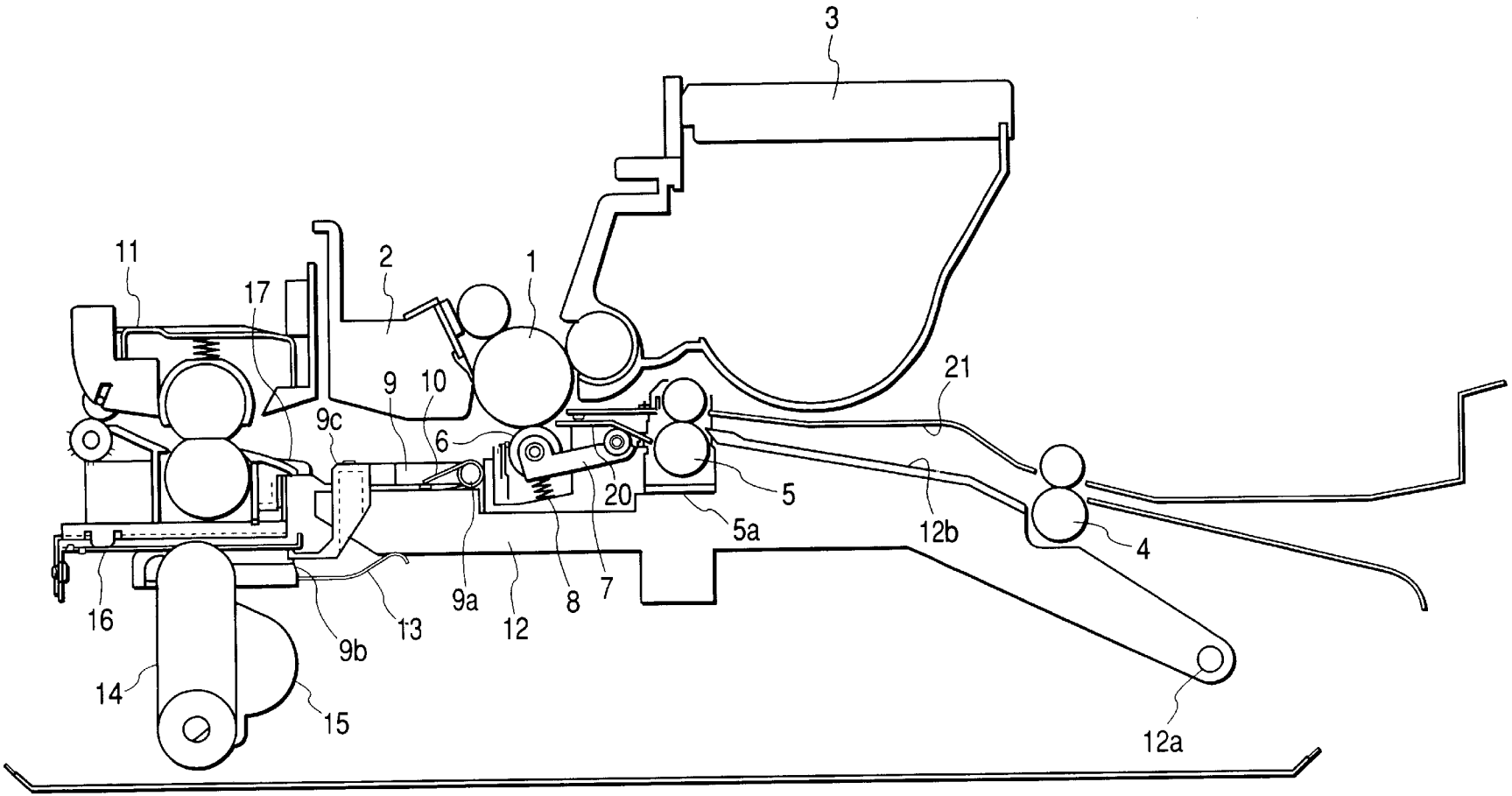
FIG. 1 is a view showing a structure of a main part of an image forming apparatus in accordance with the present invention.
Figure 2:
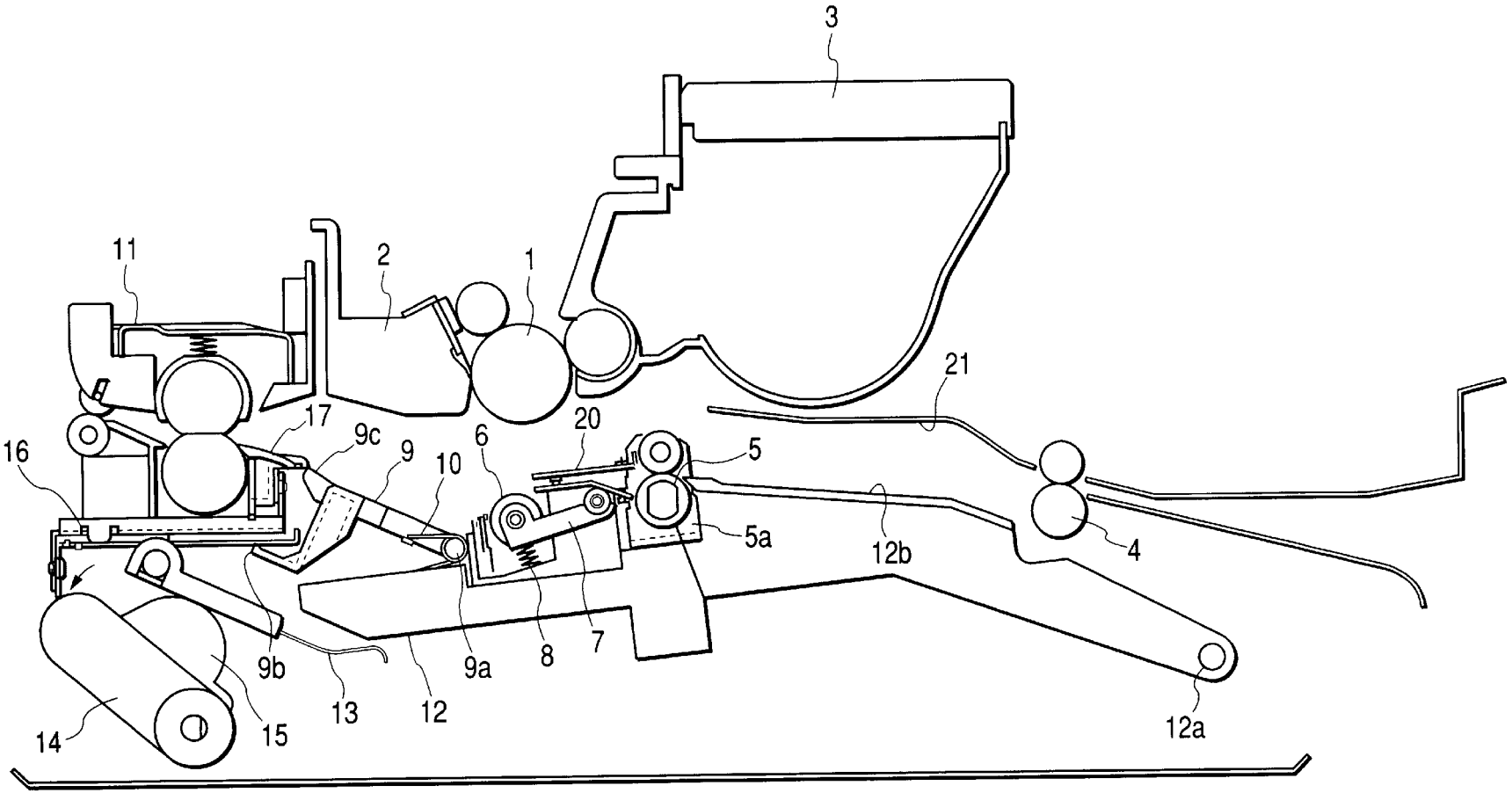
FIG. 2 illustrates an operation for lowering a conveying frame in the structure shown in FIG. 1.
Figure 3:
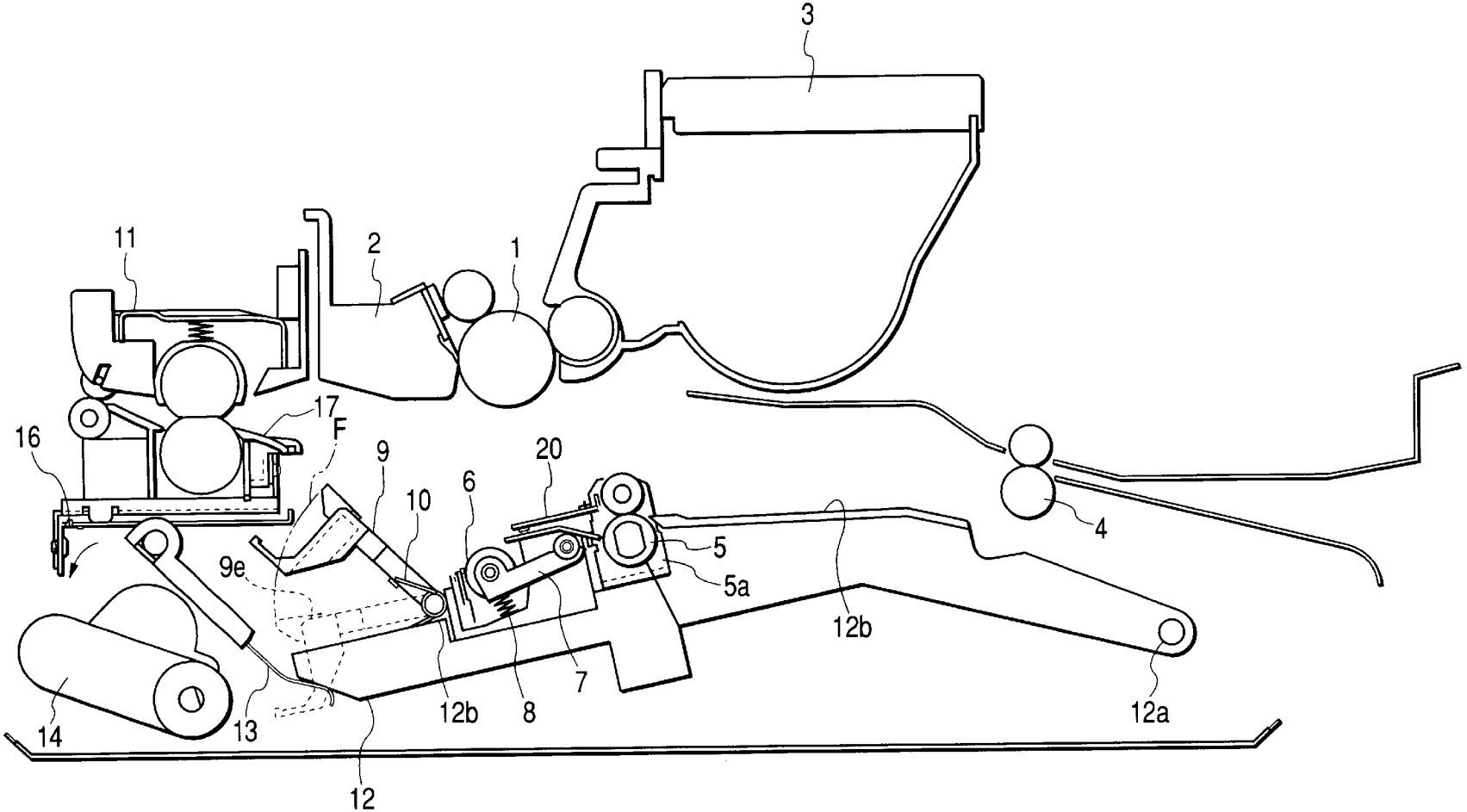
FIG. 3 illustrates a state in which the conveying frame is lowered in the structure shown in FIG. 1.
Figure 4:
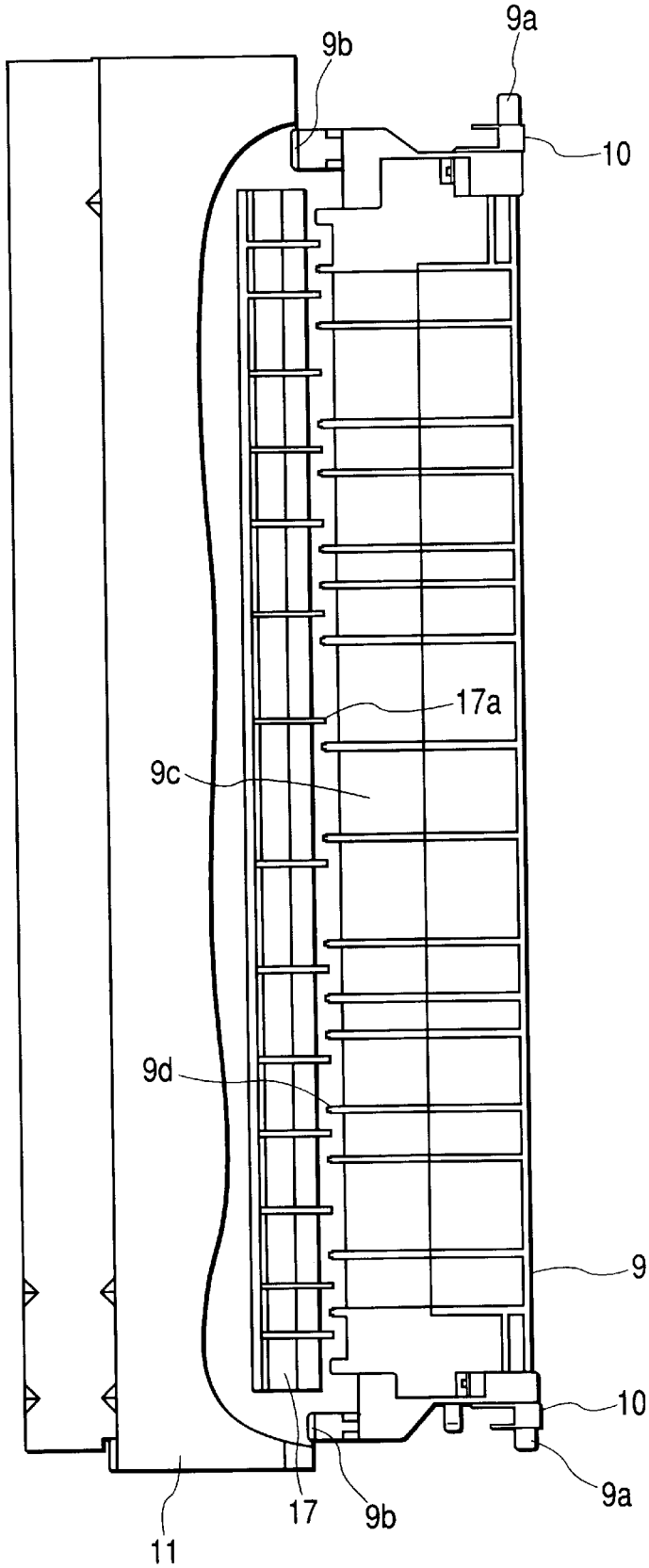
FIG. 4 is a plan view illustrating a structure of a conveying guide shown in FIG. 1.

FIG. 1 is a view schematically showing a structure of an image forming apparatus in accordance with this embodiment, FIG. 2 is a view schematically illustrating an operation of lowering a conveying frame, FIG. 3 is a view schematically illustrating a state in which the conveying frame is lowered and FIG. 4 is a plan view illustrating a structure of a conveying guide. Further, dimensions, materials and shapes of components and their relative arrangements described in the embodiment are not intended to limit the scope of the present invention to them only unless specifically described otherwise.

In this embodiment, the image forming apparatus is described with a laser printer as an example. In FIG. 1, an image forming unit is provided with a photosensitive drum 1 functioning as an image bearing member, a cleaner 2 for cleaning the photosensitive drum 1, a developing device 3 for developing toner on the photosensitive drum 1 and a transfer roller 6 that is disposed in a part opposing the photosensitive drum 1 and functions as transferring means for transferring a toner image to a sheet. The transfer roller 6 is supported by a transfer arm 7 and biased by a spring 8 toward the photosensitive drum 1 at a predetermined pressure.

In this laser printer, laser is emitted from a not-shown laser scanner based on image information obtained from an external apparatus and irradiated on the photosensitive drum 1. Consequently, a latent image is formed on the photosensitive drum 1 and the latent image is developed by the developing device 3, whereby a toner image is formed.

On the other hand, sheets contained in not-shown sheet supporting means such as a cassette are separated and fed one by one, and conveyed by a pre-transfer roller pair 5 to a nip between the photosensitive drum 1 and the transfer roller 6.

Then, the toner image is transferred from the photosensitive drum 1 to the sheets by the transfer roller 6 that is biased by the spring 8 toward the photosensitive drum 1 at the predetermined pressure. In addition, the toner image remaining on the photosensitive drum 1 after the transfer is removed by the cleaner 2 and the photosensitive drum 1 is served for the next image formation.

A registration roller pair 4 is disposed on the upstream side of the transferring means. The registration roller pair 4 corrects skew feeding of a sheet forwarded from the sheet supporting means and forwards the sheet while aligning a position of a toner image formed on the photosensitive drum 1 with that of the sheet. The registration roller pair 4 consists of a driving roller and a driven roller. A not-shown clutch such as an electromagnetic clutch functioning as connection switching means is provided on the axis of the registration roller on the driving side, whereby a driving force from not-shown driving means for driving the photosensitive drum 1 is transmitted. A sheet conveyed by the registration roller pair 4 is fed to the transferring means by the pre-transfer roller pair 5 provided immediately in front of the transferring means. The pre-transfer roller pair 5 is rotatably supported by a roller stand 5*a*.

Since skew feeding of a sheet to be conveyed is already corrected by the registration roller pair 4, the pre-transfer roller pair 5 is not required to correct such skew feeding. Thus, a clutch for turning on and off a driving force is unnecessary and a roller pressure can be reduced. In this embodiment, a roller pressure of the pre-transfer roller pair 5 is set as approximately 1 kg, which is substantially half of that of the registration roller pair 4. Consequently, vibration of a sheet material at the instance when the rear end of the sheet passes through the nip portion of the pre-transfer roller pair 5 is reduced and transfer deviation can be prevented from occurring. That is, for cases in which a pre-transfer roller pair is not provided, since a roller pressure of a registration roller pair is high as described in the prior art, a sheet vibrates when its rear end passes through the registration roller pair to cause a problem of transfer deviation or the like. If a pre-transfer roller with a low roller pressure is used, such a problem can be solved. Further, the pre-transfer roller pair 5 is driven in connection with the photosensitive drum 1 by not-shown driving means.

A transfer guide pair 20 for guiding a sheet material is disposed between the pre-transfer roller pair 5 and the transferring means.

A conveying guide 9 to be described later is disposed on the downstream side of the transferring means and guides a sheet to a fixing device 11 functioning as fixing means. The sheet is heated and pressurized in the fixing device 11 and a toner image is fixed on the sheet. Then, the sheet is further conveyed and discharged to the outside of the apparatus by a not-shown discharge roller pair to complete the image formation. In this embodiment, the distance between the fixing device 11 and a transfer roller 6 is set smaller than a size of a postcard, which is the smallest size of conveyable paper, whereby it becomes unnecessary to provide a roller pair between the fixing device 11 and the transfer roller 6 or to provide a transfer fan.

Here, the roller stand 5*a* and the pre-transfer roller pair 5, the transfer roller 6 and the transfer arm 7 as well as the conveying guide 9 are supported by a conveying frame 12. The conveying frame 12 is provided such that it is rotatable with respect to an apparatus main body by a rotation fulcrum 12*a* provided on the upstream side in the sheet conveying direction. Thus, when the conveying frame 12 is in the closed position, a conveying path is formed to convey the sheet to the transferring means, whereby the image formation is carried out. Then, the conveying frame 12 rotates in the counterclockwise direction from the closed position, thereby rotating to an opened position for opening the conveying path.

An upper surface 12*b* of the conveying frame 12 forms a lower conveying guide for conveying a sheet and guides the sheet from the registration roller pair 4 to the pre-transfer roller pair 5 in cooperation with a conveying guide 21 provided on the apparatus main body side.

The conveying frame 12 is biased in the clockwise direction in the figure by a pressurizing plate 13 functioning as locking means formed of an elastic member. The conveying frame 12 therefore abuts a not-shown positioning portion of the cleaner 2 and is fixed in the closed position. As a result, the transfer roller 6 and the conveying guide 9 are arranged in predetermined positions with respect to the photosensitive drum 1. The pressurizing plate 13 is rotated by a cum 15 fixed to a handle 14. When the handle 14 is rotated, the lock of the conveying frame 12 by the pressurizing plate 13 is released to make the conveying frame 12 rotatable from the closed position to the opened position.

The conveying guide 9 has a rotational fulcrum 9*a* on the upstream side in the sheet conveying direction and is rotatably disposed on the conveying frame 12. In addition, biasing means 10 is attached to the rotational fulcrum 9*a* and biases the conveying guide 9 in the direction for separating it from the conveying frame 12 (in the clockwise direction in the figure), as shown in FIG. 2. Further, a rib 9*b* is protrudingly provided in the lower part of the conveying guide 9. The rib 9*b* abuts a fixing stay 16 (positioning means) for supporting the fixing device 11, whereby the position of the conveying guide 9 is regulated against an biasing force of the biasing means 10.

In addition, an entrance guide 17 functioning as a guide member is disposed on the upstream side in the conveying direction of the fixing device 11 and opposes a tip portion 9*c* of the conveying guide 9. As shown in FIG. 4, a plurality of protrusions 9*d* extending toward the downstream side in the conveying direction are provided in the tip portion 9*c* of the conveying guide 9 and a plurality of protrusions 17*a* extending toward the upstream side in the conveying direction are provided in the entrance guide 17. These protrusions 9*d* and 17*a* are structured to be alternately disposed and located such that they overlap each other on a substantially identical plane in the state in which sheets can be conveyed.

Since the image forming apparatus is structured as described above, the protrusions 9*d* of the conveying guide 9 and the protrusions 17*a* of the entrance guide 17 can overlap each other in the sheet conveying direction. Thus, a gap is not created between the conveying guide 9 and the entrance guide 17 and it becomes possible to set a step in the height direction small. Therefore, even a sheet curled down can be smoothly conveyed and, in addition, jam or skew feeding caused by collision of a conveyed sheet on the entrance guide 17 can be prevented from occurring and defectiveness of an image such as transfer deviation due to impact can be prevented from being generated, whereby conveyability can be improved.

An image forming operation of this embodiment will be described next.

When a copy button is pressed on a not-shown operating unit, a sheet is fed from sheet supporting means such as a feeding cassette and sent to the registration roller pair 4. The registration roller pair 4 causes the sheet to form a loop in order to correct skew feeding of the sheet and, thereafter, a clutch is turned on at appropriate timing to convey the sheet to the pre-transfer roller pair 5.

The sheet is further conveyed to the transferring means by the pre-transfer roller pair 5 and a toner image on the photosensitive drum 1 is transferred to the sheet. At this point, the rear end of the sheet has passed through the nip portion of the registration roller pair 4. Vibration of the sheet at the instance when its rear end has passed through the nip portion of the registration roller pair 4 is prevented by the pre-transfer roller pair 5 and does not affect transfer of an image by the transferring means. As a result, since transfer deviation can be prevented, high quality of an image formed on the sheet can be realized. Further, as described above, since the roller pressure of the pre-transfer roller pair 5 is set low, the vibration of the sheet at the instance when its rear end has passed through the pre-transfer roller pair 5 is reduced and does not cause transfer deviation.

The sheet to which the toner image is transferred by the transferring means is heated and pressurized by the fixing device 11 and the toner image is fixed thereon. Then, the sheet is discharged to the outside of the apparatus by the not-shown discharge roller pair and the image forming operation ends.

Next, an operation in processing jam will be described. When jam occurs, as shown in FIG. 2, the handle 14 is rotated in the counterclockwise direction in the figure, whereby the cum 15 also rotates in the counterclockwise direction and the pressurizing plate 13 falls following the rotation. Consequently, support of the conveying frame 12 is released and the conveying frame 12 begins to rotate about the rotational fulcrum 12*a*. In this case, even if the conveying frame 12 starts falling, since the conveying guide 9 tends to rotate in the direction for separating from the conveying frame 12 by an biasing force of the biasing means 10, the rotational fulcrum 9*a* side of the conveying frame 12 falls while the rib 9*b* in its lower part remains contacting the fixing stay 16. Thus, it is possible to rotate the conveying frame 12 without the tip portion 9*c* of the conveying guide 9 interfering with the entrance guide 17.

Then, when the conveying frame 12 has completely fallen as shown in FIG. 3, the sheet conveying path between the photosensitive drum 1 and the fixing device 11 is opened to bring the image forming apparatus to the state in which jam processing can be performed. At this point, the conveying guide 9 rotates in the direction separating from the conveying frame 12 (clockwise direction) by the biasing means 10 and comes to a halt at a predetermined angle by abutting a protrusion 12*b* on the conveying frame 12. When the jam processing is performed in this state, an operator touches the conveying guide 9 to allow it to freely rotate to a position (broken line 9*e*) along the conveying frame 12 drawing a locus F and a sufficient space for performing the jam processing is secured.

At this point, since the pre-transfer roller 5 simultaneously moves downward, even if the sheet is bit by the pre-transfer roller 5, the jam processing can be performed by turning a not-shown knob coaxially provided on the pre-transfer roller 5.

After the jam processing ends, the handle 14 is rotated in the clockwise direction in the figure, whereby the conveying frame 12 rotates and can be brought to the state in which it is conveyable.

In addition, if the conveying frame 12 is provided detachably attachable by opening means, since the transfer unit 6, the transfer guide pair 20 and the pre-transfer roller 5 are exposed simply by removing the conveying frame 12 in case of service maintenance or the like, operations such as cleaning and replacement are improved.

Thus, it is seen that an image forming apparatus is provided. One skilled in the art will appreciate that the present invention can be practiced by other than the preferred embodiment which is presented for the purposes of illustration and not of limitation, and the present invention can be modified in any way within the technical thoughts of the present invention.

What is claimed is:

1. An image forming apparatus comprising:

an image bearing member;

a registration roller pair for correcting skew feeding of a sheet to be conveyed and for conveying a sheet along a conveying path;

transferring means, which is provided opposing said image bearing member across said conveying path, for transferring a toner image formed on said image bearing member to a sheet to be conveyed by said registration roller pair;

a pre-transfer roller pair, which is provided between said registration roller pair and said transferring means, for conveying the sheet to be conveyed from said registration roller pair first to said transferring means; and holding means for holding said pre-transfer roller pair and said transferring means, wherein said holding means is provided rotatably about a fulcrum provided on the upstream side of said registration roller pair in the sheet conveying direction, and said holding means rotates between a closed position where an image is formed on the sheet by said image bearing member and an opened position for opening the conveying path between said transferring means and said image bearing member.

2. An image forming apparatus according to claim 1, further comprising locking means for locking said holding means in said closed position.

3. An image forming apparatus comprising:

an image bearing member;

a registration roller pair for correcting skew feeding of a sheet to be conveyed and for conveying a sheet along a conveying path;

transferring means, which is provided opposing said image bearing member across said conveying path, for transferring a toner image formed on said image bearing member to a sheet to be conveyed by said registration roller pair;

a pre-transfer roller pair, which is provided between said registration roller pair and said transferring means, for conveying the sheet to be conveyed from said registration roller pair to said transferring means; and holding means for holding said pre-transfer roller pair and said transferring means, wherein said holding means is capable of opening the conveying path between said transferring means and said image bearing member, and wherein said pre-transfer roller pair has a pressure for pressure contacting a sheet, which is set smaller than that of said registration roller pair.

4. An image forming apparatus according to claim 3, wherein said pre-transfer roller has the pressure being set substantially half of that of said registration roller pair.

5. An image forming apparatus comprising:

an image bearing member;

a registration roller pair for correcting skew feeding of a sheet to be conveyed and for conveying a sheet along a conveying path;

transferring means, which is provided opposing said image bearing member across said conveying path, for transferring a toner image formed on said image bearing member to a sheet to be conveyed by said registration roller pair;

a pre-transfer roller pair, which is provided between said registration roller pair and said transferring means, for conveying the sheet to be conveyed from said registration roller pair to said transferring means; and holding means for holding said pre-transfer roller pair and said transferring means, wherein said holding means is capable of opening the conveying path between said transferring means and said image bearing member, and wherein the conveying path between said transferring means and said registration roller pair is set shorter than a length of the sheet in the conveying direction.

6. An image forming apparatus comprising:

an image bearing member;

first conveying means for conveying a sheet along a conveying path;

transferring means, which is provided opposing said image bearing member across said conveying path, for transferring a toner image formed on said image bearing member to a sheet to be conveyed by said first conveying means;

second conveying means, which is provided between said first conveying means and said transferring means, for conveying a recording material to be conveyed from said first conveying means to said transferring means;

holding means for holding said second conveying means and said transferring means, wherein said holding means is capable of opening the conveying path between said transferring means and said image bearing member;

fixing means for fixing the sheet to which the toner image is transferred by said transferring means; and, a conveying guide provided in said holding means for guiding the sheet from said transferring means to said fixing means, wherein said conveying guide is rotatably attached to said holding means by a fulcrum provided on an upstream side in a sheet conveying direction and is biased in a direction for separating from said holding means by biasing means.

7. An image forming apparatus according to claim 6, wherein said conveying guide is positioned against a biasing force of said biasing means by positioning means near said fixing means.

8. An image forming apparatus according to claim 7, wherein said fixing means has a guide member for guiding a sheet to the upstream side in the sheet conveying direction and, when said holding means is rotated in a direction for separating from said image bearing member, said conveying guide is separated from said holding means by said positioning means near said fixing means, and an end portion on a downstream side of said conveying guide is held in a position near an end portion on the upstream side of said guide member.

9. An image forming apparatus according to claim 6, wherein said fixing means has a guide member for guiding the sheet to the upstream side in the sheet conveying direction, a plurality of protrusions extending in the conveying direction are provided in said conveying guide and said guide member, the plurality of protrusions of said conveying guide and said guide member being structured to be alternately disposed and overlap each other on a substantially identical plane.

10. An image forming apparatus according to claim 6, wherein a distance between said fixing means and said transferring means is set shorter than a length of a smallest conveyable sheet.

* * * * *

UNITED STATES PATENT AND TRADEMARK OFFICE

CERTIFICATE OF CORRECTION

PATENT NO. : 6,628,911 B2
DATED : September 30, 2003
INVENTOR(S) : Shinichi Konno It is certified that error appears in the above-identified patent and that said Letters Patent is hereby corrected as shown below:

Column 1,
Line 37, “bit” should read -- nipped --.

Column 4,
Line 20, “cum” should read -- cam --.

Column 5,
Line 28, “cum” should read -- cam --.

Column 6,
Line 27, “first” should be deleted.

Signed and Sealed this

Sixteenth Day of March, 2004

JON W. DUDAS
*Acting Director of the United States Patent and Trademark Office*